US007510152B2

(12) United States Patent
Melic

(10) Patent No.: US 7,510,152 B2
(45) Date of Patent: Mar. 31, 2009

(54) GUARD RAIL SAFETY SYSTEM

(76) Inventor: Jonathan Jonny Melic, 37 Sunvale Place, Stoney Creek, Ontario (CA) N8E 4Z6

( * ) Notice: Subject to any disclaimer, the term of this patent is extended or adjusted under 35 U.S.C. 154(b) by 0 days.

(21) Appl. No.: 11/819,531

(22) Filed: Jun. 28, 2007

(65) Prior Publication Data

US 2007/0252055 A1 Nov. 1, 2007

Related U.S. Application Data

(63) Continuation of application No. 10/901,141, filed on Jul. 29, 2004, now Pat. No. 7,255,312.

(51) Int. Cl.
*E04G 25/00* (2006.01)
*A47F 5/00* (2006.01)

(52) U.S. Cl. ..... 248/200.1; 248/354.1; 248/354.3; 52/126.1; 52/126.6; 211/105.6

(58) Field of Classification Search ..... 248/200.1, 248/354.3, 354.4, 354.5, 354.6, 546, 354.1, 248/354.7, 357, 188.2, 188.4; 211/47, 105.6, 211/86.01; 160/368.1, 351; 52/126.1, 126.6, 52/126.7

See application file for complete search history.

(56) References Cited

U.S. PATENT DOCUMENTS 1,639,551 A * 8/1927 Booth ..... 211/105.6
2,903,227 A * 9/1959 Key ..... 248/200.1
3,143,331 A * 8/1964 Corey ..... 248/200.1
3,333,808 A * 8/1967 Du Boff ..... 248/200.1
3,822,850 A 7/1974 Elias
3,920,220 A * 11/1975 Elias ..... 248/200.1
3,961,822 A * 6/1976 Daniel ..... 248/200.1
5,833,081 A * 11/1998 Smith ..... 211/86.01
5,924,469 A * 7/1999 Whittemore ..... 160/368.1
7,255,312 B2 * 8/2007 Melic ..... 248/200.1
7,273,200 B2 9/2007 Funes Gavilan
2007/0257180 A1 * 11/2007 Melic ..... 248/551

FOREIGN PATENT DOCUMENTS

| | | |
|---|---|---|
| AU | 603455 | 12/2008 |
| BE | 538792 | 6/1955 |
| EP | 05770399.3 | 5/2007 |
| EP | 1921226 | 5/2008 |
| FR | 369806 | 1/1907 |

* cited by examiner

*Primary Examiner*—Amy J. Sterling
*Assistant Examiner*—Tan Le

(57) ABSTRACT

A support post and safety fence assembly in which the post has a telescoping inner and outer tube and is supported on a threaded internal shaft coupled to a floor engaging end and ceiling engaging end preferably formed with claws that have a number of sharp penetrating points for firm engagement with a support surface. In one embodiment, a gravity lock assembly is provided for fixing the relative position of the inner and outer tubes. Dynamic adjustability of the support post is provided by internal compression springs.

3 Claims, 8 Drawing Sheets

GUARD RAIL SAFETY SYSTEM

RELATED APPLICATION

This application is a continuation of U.S. patent application Ser. No. 10/901,141 filed Jul. 29, 2004 now U.S. Pat. No. 7,255,312.

FIELD OF INVENTION

This invention relates to a safety post and fence assembly for use at a construction site.

BACKGROUND OF THE INVENTION

Safety barriers or fences are used during the construction of high rise buildings to prevent construction workers from falling from the building and injuring themselves. They are also useful to prevent materials from falling from the building and for catching any flying debris being blown against the barriers and injuring people below. The safety barriers need to be set up and taken down with relative ease since they are temporary and frequently moved from one location to another as the construction progresses. A safety barrier of this type typically comprises a plurality of posts supporting intervening fence panels.

Various types of support posts and fencing assemblies have been designed to try and address this need for a safety barrier. U.S. Pat. No. 3,822,850 discloses a support for a construction fence. The support comprises a telescoping jack post which can be adjusted to fit snuggly between a floor and ceiling. U.S. Pat. No. 3,589,682 discloses another type of telescopic fence column which has a manually operable jacking system and upper and lower pads for contacting the ceiling and floor of a portion of the building. U.S. Pat. No. 3,946,992 discloses another type of construction fence post which comprises a C-shaped bracket which is used to clamp the post to the edge of the floor section. U.S. Pat. No. 3,734,467 describes an upright for a wall partition which has a compression spring that allows for frictional engagement of the upright between floors of a building under construction. U.S. Pat. No. 6,679,482 discloses an improved construction perimeter guide stanchion. An adjustment system allows one to tightly clamp the pair of jaws at the lower end of the stanchion to the edge of a floor slab in an elevated unfinished building.

Although many attempts have been made to design improved safety barrier systems, there remains a need for a system that is easily erected and dismantled and which is self-adjusting, easily packaged safer and tamper-proof.

SUMMARY OF THE INVENTION

A support post and safety fence assembly in which the post has a telescoping inner and outer tube and is supported on a threaded internal shaft coupled to a floor engaging end and ceiling engaging end preferably formed with claws that have a number of sharp penetrating points for firm engagement with a support surface. In one embodiment, a gravity lock assembly is provided for fixing the relative position of the inner tube and outer tube. Dynamic adjustability of the support post is provided by internal compression springs which also allow the port to be temporarily positioned in an upright position prior to securement.

DESCRIPTION OF PREFERRED EMBODIMENTS WITH REFERENCE TO DRAWINGS

Figure 1:
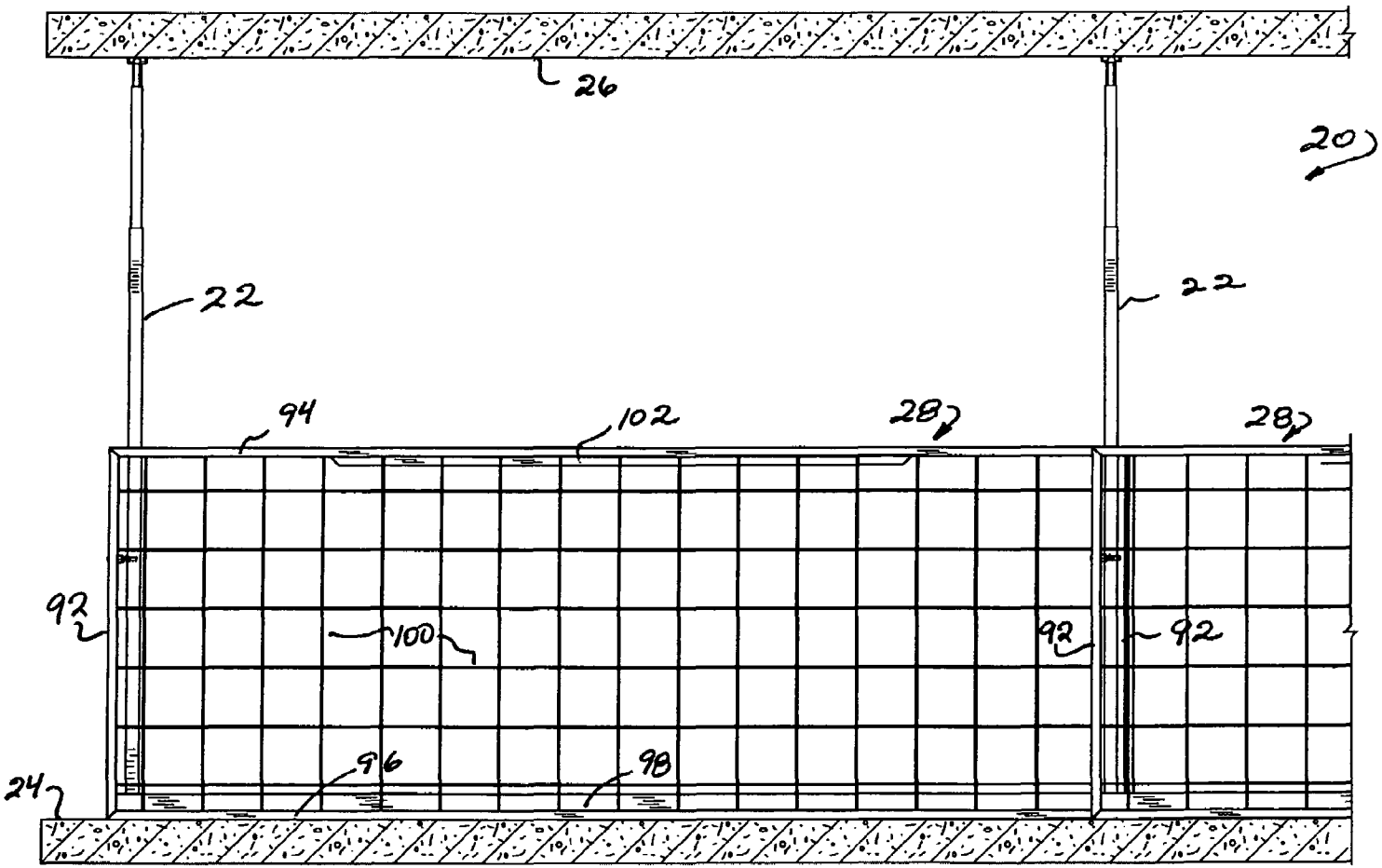
FIG. 1 is a side elevation view of a safety post and fence assembly positioned between two floors of a building under construction.

The invention provides a safety fence assembly generally indicated by reference numeral 20 and consisting of a plurality of upright support posts 22 that extend between a supporting surface or floor 24 and a ceiling 26. The posts are normally positioned adjacent to an opening and spaced apart by a distance commensurate with the length of an associated fence panel or barrier 28. The fence panel 28 is normally positioned on the interior side of the associated support post 22 and thus in the view of FIG. 1, the observer would be looking out of a building, the floor 24 and ceiling 26 having been drawn in cross-section. As will be appreciated by those skilled in the art, the safety fence assembly 20 may be used in a number of circumstances according to the needs at the building site.

Figure 2B:
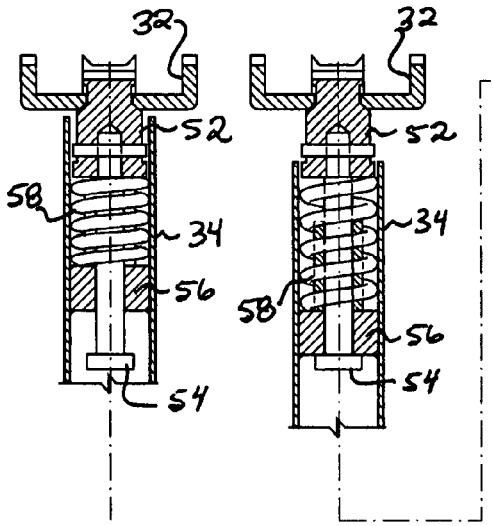
FIG. 2*b* is a cross-sectional view showing a top end of the post of FIG. 2*a* in a compressed configuration.
Figure 2D:
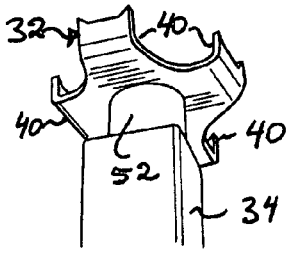
FIG. 2*d* is a perspective view showing the top end of the post of FIG. 2*a;*

The construction of the support post 22 is shown in more detail in FIGS. 2*a* through 2*e*. An overall view of the support post 22 is provided in FIG. 3*a* where it will be observed that the support post has a floor engaging end or foot 30 at one end and a similar ceiling engaging end 32 at the opposite end with a pair of telescoping inner and outer tubes 34, 36 in between. As will be seen from FIG. 3*b*, the cross-section of the inner and outer tubes is square so that rotation of the outer tube 36 will also turn the inner tube 34, as is explained further below. The coupling of the floor engaging end 30 and ceiling engaging end 32 to the support post 22 will be explained in more details with reference to FIGS. 2*a* to 2*e*.

Figure 2E:
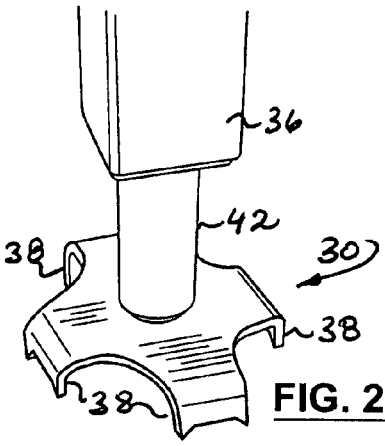
FIG. 2*e* is a perspective view showing a bottom end of the post of FIG. 2*a;*
Figure 2C:
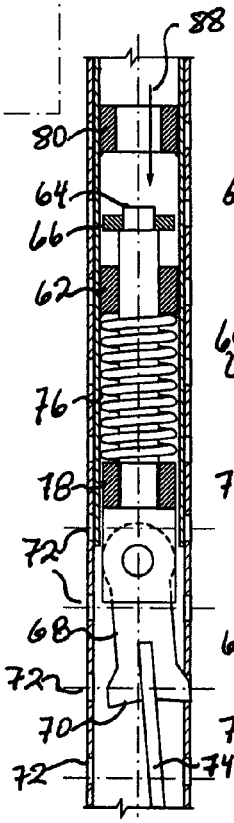
FIG. 2*c* is a cross-sectional view of a center portion of the post of FIG. 2*a* with a lock positioned in engagement with an outer tube.
Figure 3A:
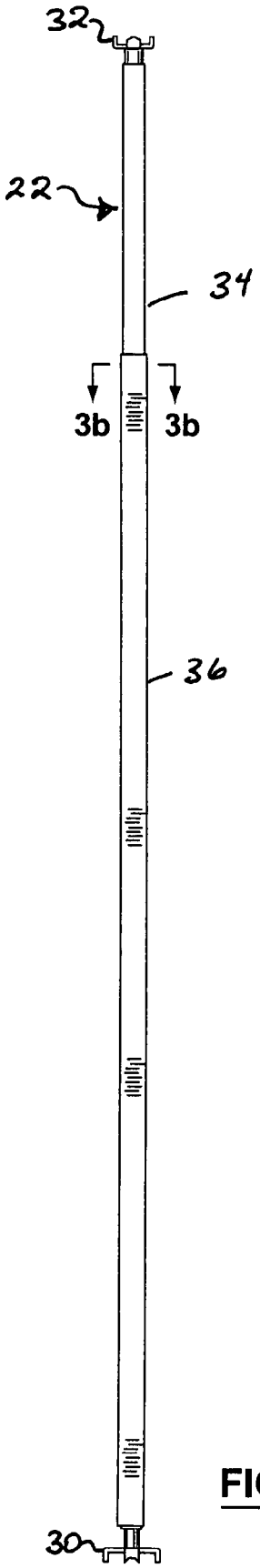
FIG. 3*a* is a side elevation view of the post.
Figure 3B:
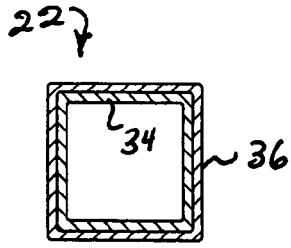
FIG. 3*b* is a cross-sectional view drawn on line 3*b*-3*b* of FIG. 3*a;*

As will be observed in the detail view of FIG. 2*e*, the foot 34 has a cruciform shape with four claws 38 each having a pair of sharp penetrating points for firm engagement with a supporting surface. It will be observed that the points are spaced apart and each has a length that is selected to limit penetration into a supporting surface. This configuration allows safety post 22 to come into firm engagement with the associated floor 24 and to penetrate any surface frost or dust which might otherwise interfere with safe operation of the post. By limiting penetration of the claw into an associated surface, damage to the surface is avoided.

As will observed from FIG. 2*d*, the ceiling engaging end 32 has a similar cruciform configuration with four claws 40 of similar shape. However, it will be observed that the separation between opposing pairs of claws 40 in the ceiling engaging end 32 is smaller than the separation between pairs of claws 38 in the floor engaging end 30. Thus, the floor engaging end 30 has a bigger "footprint" than the ceiling engaging end 32 for increased stability at the operatively lower end of the support post 22 where it needs to support any fence panels 28. Conveniently, the floor engaging end 30 and ceiling engaging end 32 can be nested thereby saving space during shipping.

The floor engaging end 30 is rotatably coupled to a reduced diameter portion of a shaft 42 which extends upwardly in the operative orientation of the support post 22. The shaft 42 is a solid steel bar that has a free end 44 that is threaded along its length and concealed from view inside the outer tube 36. The outer tube 36 has an internal nut 46 welded to its interior surface adjacent a lower end thereof and having complementary threads to the threaded end 44 of the shaft 42. The lower extremity of the outer tube 36 has a guide bushing 48 for sliding engagement with the shaft 42 and which closes the lower end of the outer tube 36 to prevent the ingress of dirt into the assembly. A plate 50 is welded to the interior surface of the outer tube 36 above the height of the threaded end 44 of the shaft 42 to prevent any dirt from falling into the assembly from the top of the support post 22.

The ceiling engaging end 32 is rotatably coupled to a stem 52 which is slidingly received in the operatively upper end of the inner tube 34. The stem 52 carries a longitudinally extending pin 54 which has a head that locates against a collar 56 welded to the interior surface of the inner tube 34. A top compression spring 58 is captured between the supporting collar 56 and the stem 52. Thus, the application of pressure to the ceiling engaging end 32 will cause the stem 52 to penetrate into the inner tube 34 and compress the compression spring 58 as illustrated by FIG. 2*b*. The lower end of inner tube 34 supports a gravity lock assembly generally indicated by reference numeral 60 which is used to fix the relative position of the telescoping inner and outer tubes 34, 36. A supporting collar 62 is welded to an interior surface of the inner tube 34 a short distance from the operatively lower end of the inner tube. The supporting collar supports a longitudinally extending pendulum stem 64 with associated flange 66 that, in use, extends downwardly to the lower extremity of the inner tube 34. At the lower end, the pendulum stem 64 is fitted into an enlarged portion which pivotally supports a pendulum lock 68. The pendulum lock 68 extends longitudinally a short distance below the pendulum stem 64 and has two oppositely disposed fins 70 that extend outwardly and are adapted to engage into a selected one of a series of longitudinally spaced apertures 72 formed in the outer tube 36. The apertures 72 are disposed in pairs formed on opposite sides of the outer tube 36. The number and spacing of the apertures 72 can be varied according to the degree of adjustability required in fixing the relative position of the inner and outer tubes 34, 36. It will also become apparent that the apertures 72 can be staggered and do not need to be provided in oppositely disposed pairs. The lower extremity of the pendulum lock 68 has a longitudinally extending tongue 74 for added weight and also to provide a bearing surface for accessing the pendulum lock 68 if it needs to be dislodged.

A center compressing spring 76 is captured at a lower end of the inner tube 34 between a locating collar 78 adjacent to the pendulum lock 68 and the supporting collar 62 which is fixed to the inner tube 34. A stop 80 is fixed to the interior of the inner tube 34 to limit the upward travel of the pendulum stem 64 and flange 66.

Figure 2A:
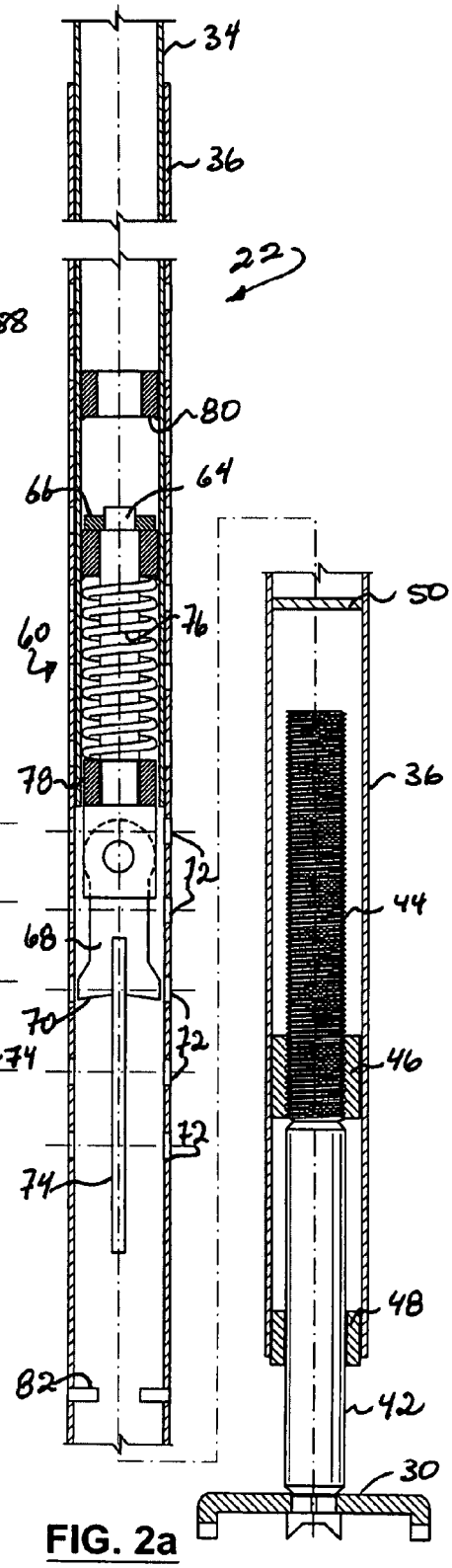
FIG. 2*a* is an assembly view of a post made in accordance with the invention.

The outer tube 36 also has a stop shown in FIG. 2*a* in the form of a washer 82 welded into its interior surface. The stop limits the downward travel of the inner tube 34 relative to the outer tube 36. It will be understood that the central aperture of the washer 82 is provided to accommodate the length of the tongue 74 from the gravity lock assembly 60.

Figure 4:
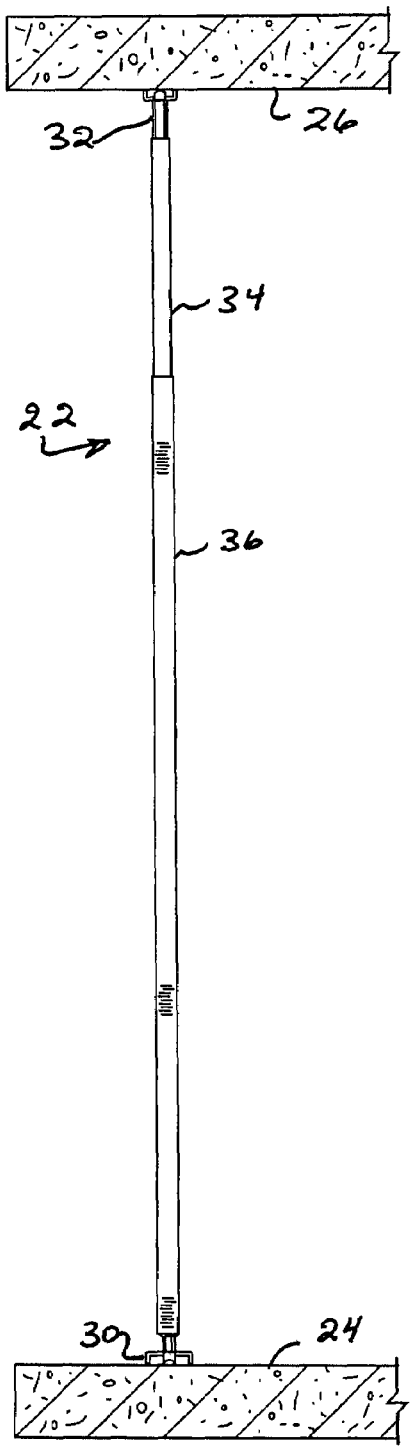
FIG. 4 is a similar view to FIG. 3*a* showing the post in position between floors of the building under construction.
Figure 5:
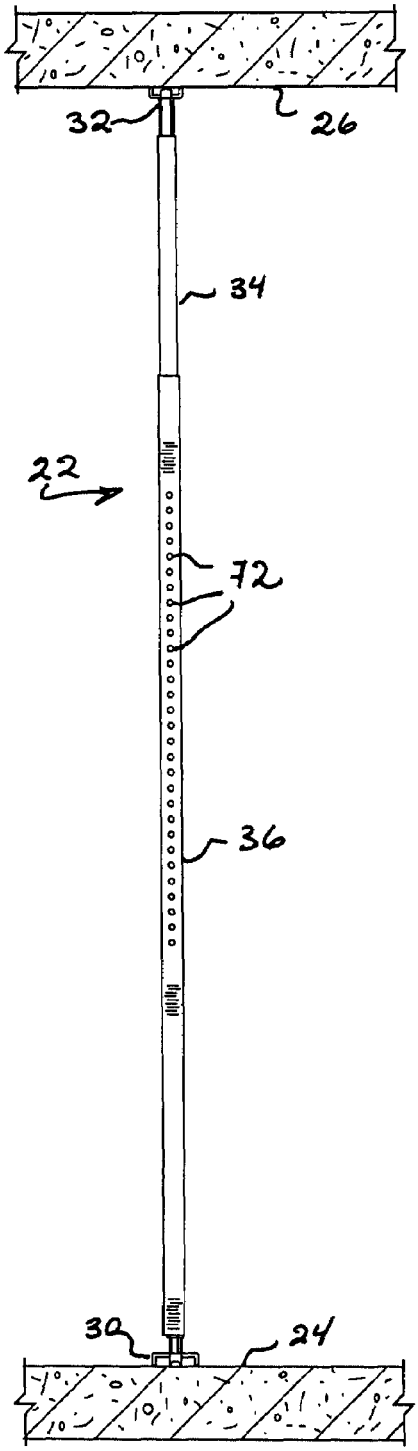
FIG. 5 is a similar view to FIG. 4 from another side.
Figures 6, 7:
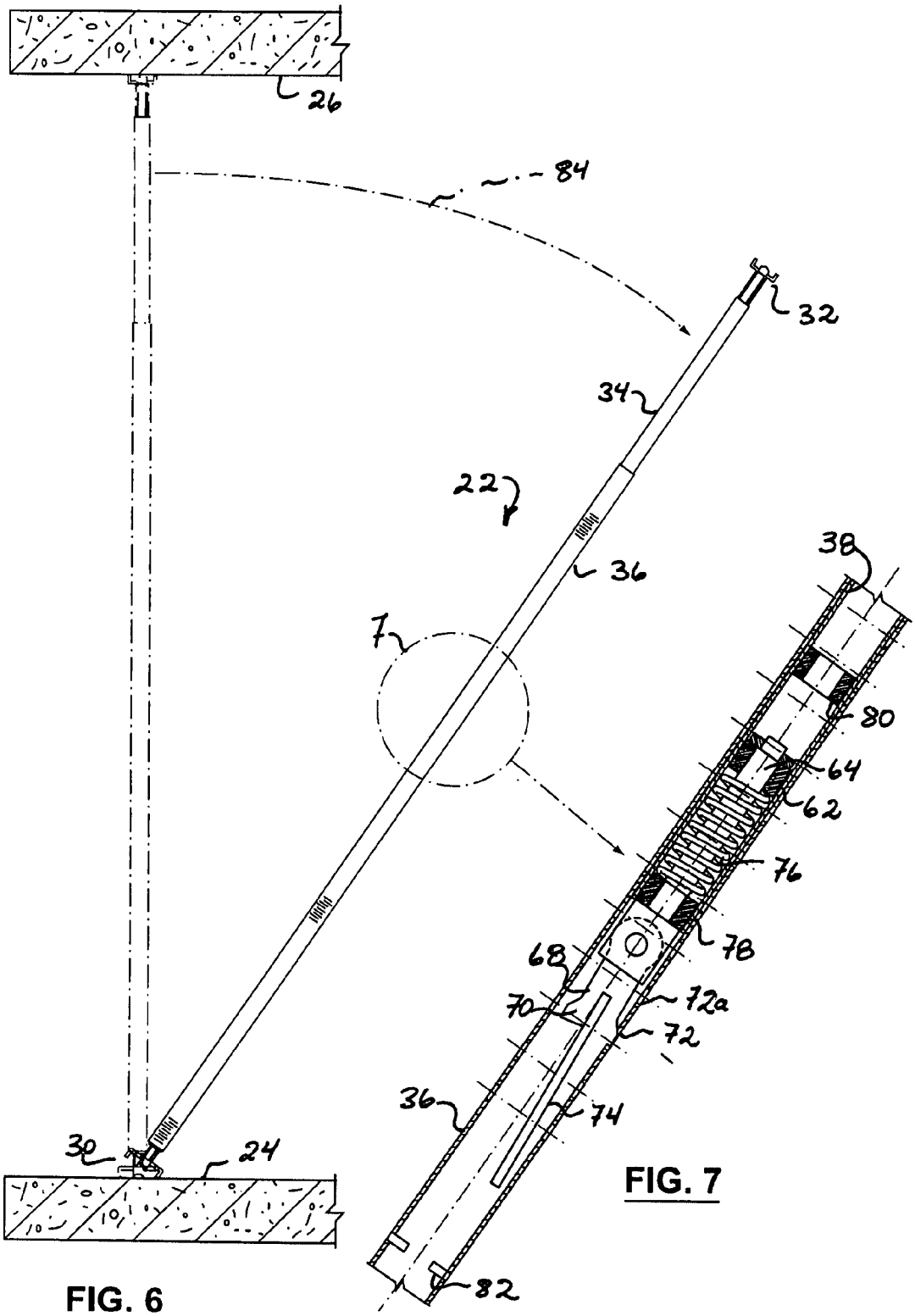
FIG. 6 is a side elevation view showing the post of FIG. 4 being lowered to a lock position.
FIG. 7 is a detail cross-sectional view of circled area 7 in FIG. 6.

The operation and installation of the support post 22 will now be described with reference being made to FIGS. 4 to 9. FIGS. 4 and 5 show the inner and outer telescoping tubes 34, 36 extended from each other so that the separation between the floor engaging end 30 and ceiling engaging end 32 approximate the height of the ceiling 26 from the floor 24. Once the approximate separation of the inner and outer tubes 34, 36 has been determined, the support post 22 is inclined as indicated by arrow 84 in FIG. 6. Inclining the support post 22 causes the pendulum lock 68 to pivot and for one of the fins 70 to come into engagement with the internal surface of the outer tube 36. The separation between the inner and outer tubes 34, 36 is then adjusted so that the fin 70 of the pendulum lock 68 is brought into engagement with the adjacent upper aperture indicated by reference numeral 72*a* in FIG. 7. Selecting upper aperture 72*a* fixes the relative position of inner and outer tubes 34, 36 so that the combined length of the support post 22 would exceed the separation between the ceiling 26 and the floor 24. Returning the support post 22 to bring the ceiling engaging end 32 into engagement with the ceiling 26 as indicated by arrow 86 in FIG. 8, causes the softer center compression spring 76 to compress against the locating collar 78 as a downward load is applied to the inner tube 34 as indicated by arrow 88 in FIG. 2*c*. Thus the center compression spring 76 operates to maintain the relative position between the inner and outer tubes 34, 36 while in the upright position prior to securement of the post.

Figure 8:
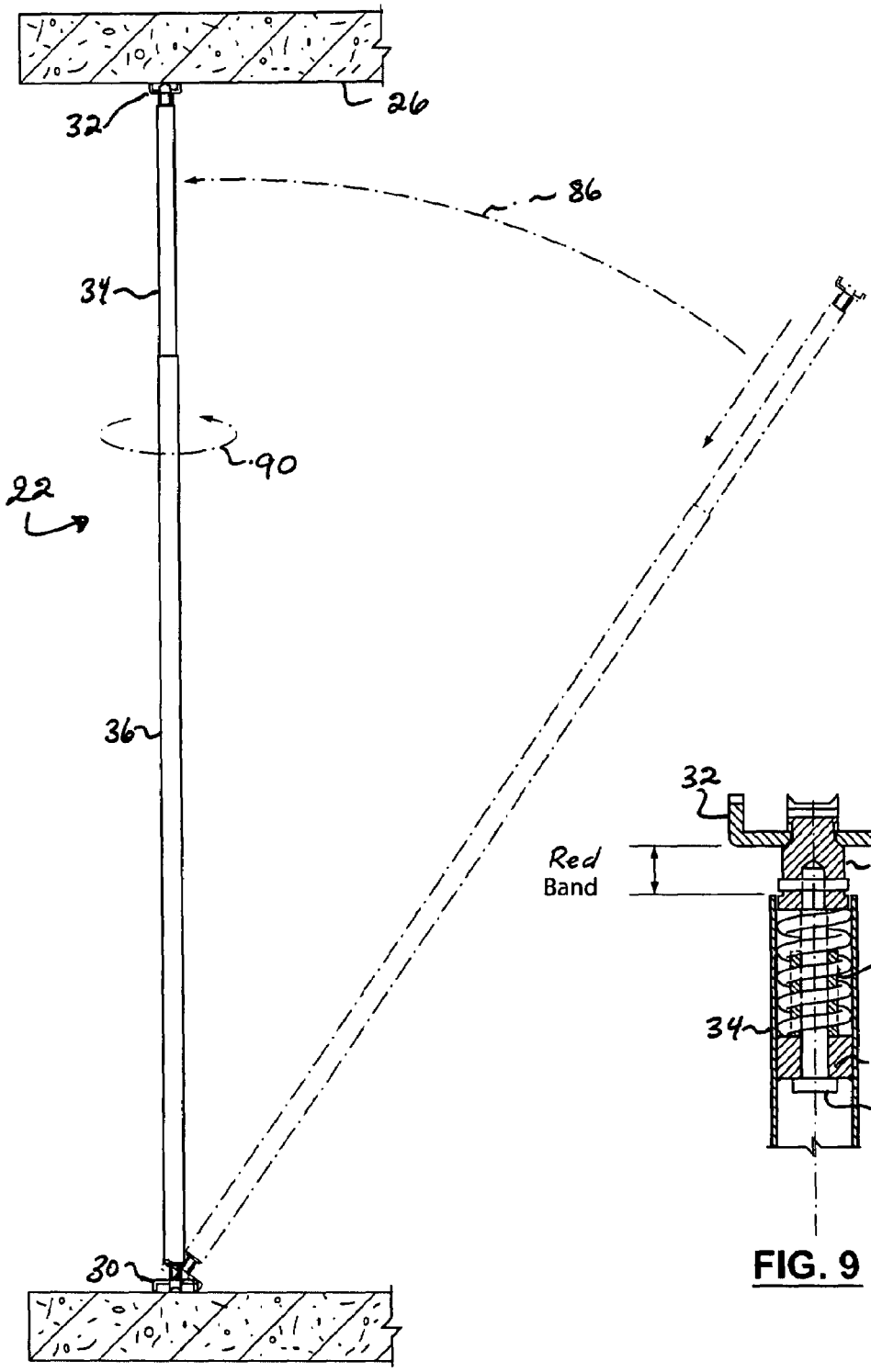
FIG. 8 is a side elevation view showing the post of FIG. 6 being returned to a vertical orientation.
Figure 9:
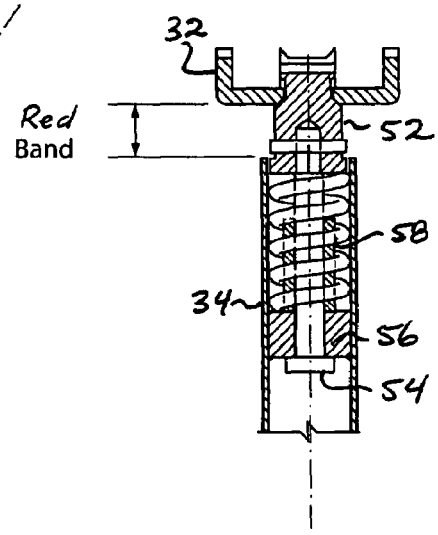
FIG. 9 is a detailed cross-sectional view of the top end of the post.

To secure placement of the support post 22, the outer tube 36 together with the inner tube 34 are rotated on the threaded shaft 42 as indicated by arrow 90 in FIG. 8. The thread of the threaded end 44 and the nut 46 are formed so that a counterclockwise rotation will bring about an upward vertical movement of the inner and outer tube assembly 34, 36. As pressure is applied to the ceiling engaging end 32, the inner tube 34 moves upwardly relative to the stem 52 thereby obscuring the stem from view. Conveniently the stem 52 may have a bright color applied to it such as a red colored band to provide a visual indication of the load being applied to the top compression spring 58 as observed in FIG. 2*b*. The inner tube 34 completely obscures the stem 52 when the compression spring 58 is fully loaded. It will be appreciated that the top compression spring 58 provides a means to respond in dynamic fashion to any small dimensional changes due to expansion or contraction of the floor and ceiling.

Once positioned, the support post 22 is extremely stable and secure so that it can successfully withstand pull or push tension tests applied to its mid portion thereby complying with regulations of the applicable health and safety legislation or other legislation. Compliance with the safety regulations is largely attributed to the greater stability and improved surface contact provided by the configuration of the floor engaging end 30 and the ceiling engaging end 32. An added advantage of the post 22 made in accordance with the invention is that the component parts are all hidden in the interior of the telescoping inner and outer tubes 34, 36 and therefore are inaccessible to any accidental tampering which would compromise the safety of the post. Conveniently, there are no auxiliary tools required for proper position of the post and therefore the post is always ready for placement without having to seek and obtain the required tools. In addition, the square configuration of the inner and outer tubes, in combination with the counter clockwise thread, allows the tubes to be manually adjusted without requiring the assistance of a torque wrench, although this may used, if required. Because of the square cross-section, gripping of the hands or the need for an auxiliary tool such as a torque wrench is minimized.

Figure 12:
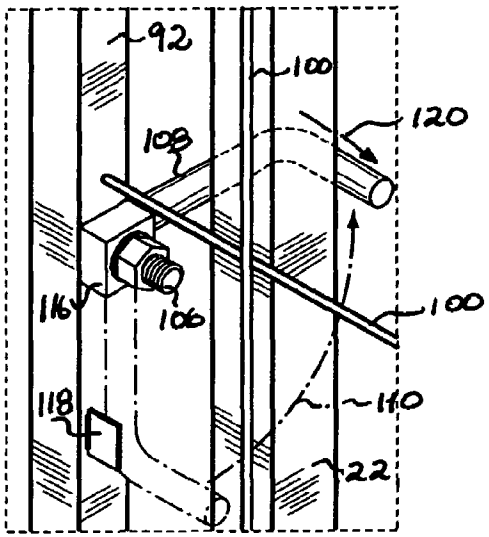
FIG. 12 is a similar view to FIG. 11 showing the fence lock in engagement to capture a fence post.
Figure 11:
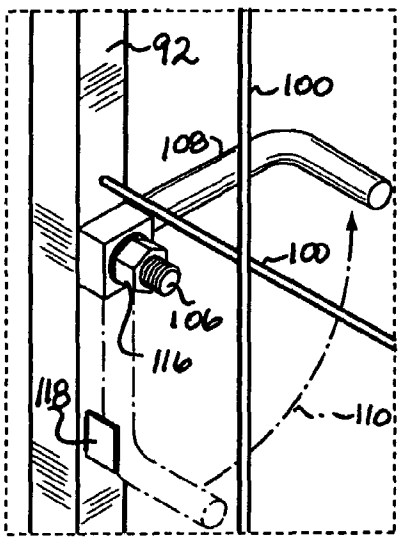
FIG. 11 is a similar view to FIG. 10 showing the fence lock in an operative locking orientation.
Figure 10:
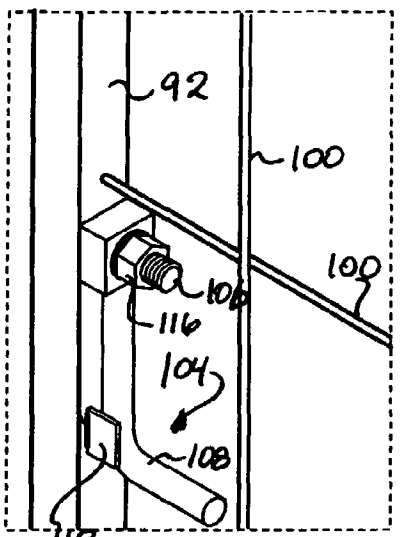
FIG. 10 is a perspective view of a portion of a fence panel and associated fence lock.
Figure 13:
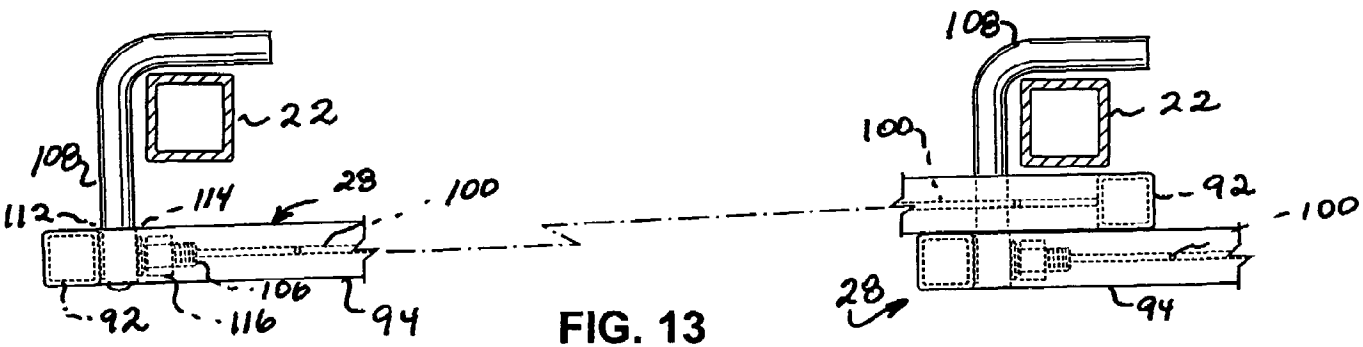
FIG. 13 is a top plan view of a pair of fence panels associated with a pair of support posts.

In use, the support post 22 is erected at selected locations and a plurality are positioned at suitable distances required to support fence panels positioned in overlapping fashion as shown in FIGS. 1 and 13 in order to form a security barrier. As shown in FIG. 1, the fence panel 28 has a generally rectangular frame which includes a pair of spaced oppositely disposed upright members 92. These are coupled to a upper horizontal member 94 and an operatively lower horizontal member 96. Conveniently, the lower horizontal member has a kick guard 98 attached to it and extending the length of the fence panel 28. A plurality of spaced horizontal and vertical wires 100 form a grid and are attached at opposite ends to the rectangular frame formed by the upright members 92 and horizontal members 94, 96. A horizontal reinforcement member is fixed to the upper horizontal member 94. A fence lock 104 is shown in more detail in FIGS. 10 to 12 and consists of a bolt 106 which is fixed to the upright 92 and has its threaded end extending through the upright 92 in a plane which is parallel to that of the rectangular frame of the fence panel 28. The inner end of the bolt 106 is secured to the upright 92 by welding. An L-shaped handle 108 is rotatably mounted to the bolt 106 and has its free end extending parallel to the bolt so that it can be rotated from the plane of the fence panel 28 outwardly as indicated by arrow 110 to a parallel plane spaced from the fence panel 28. The handle 108 is captured between a washer 112 and a spring washer 114 to which pressure is applied with a nut 116. In the shipping position of the fence lock 104, the handle 108 is brought to rest against a tab 118 that stops the handle 108 from further rotation out of the plane of fence panel. Once rotated into the position shown in FIG. 11, the fence panel 28 is slid in the direction indicated by arrow 120 to move the fence panel towards the support post 22 and capture the post between the handle 108 and the fence panel wires 100.

It will be noted that the handle 108 is sufficiently long to accommodate the fence post 22 as well as the width of a second fence panel 28 positioned between the post 22 and the fence panel as drawn to the right of FIG. 13. It will be appreciated that the fence panel 28 is thereby securely captured and will not easily become dislodged thereby improving the safety of the safety fence assembly which simplifies erection as a whole. In addition, the extent of the overlap between adjoining fence panels may be adjusted making it more or less difficult to release of an individual panel from the assembly for repositioning elsewhere or dismantling of the fence assembly.

The combination of the support post according to the invention and the fence panel with a rotatably mounted fence lock provides numerous advantages over the prior art, in particular with respect to security and safety of workers and their co-workers. It also makes the product easier to use and more practical.

An alternative embodiment of the support post according to the invention will now be described with reference to FIG. 14.

Figure 14:
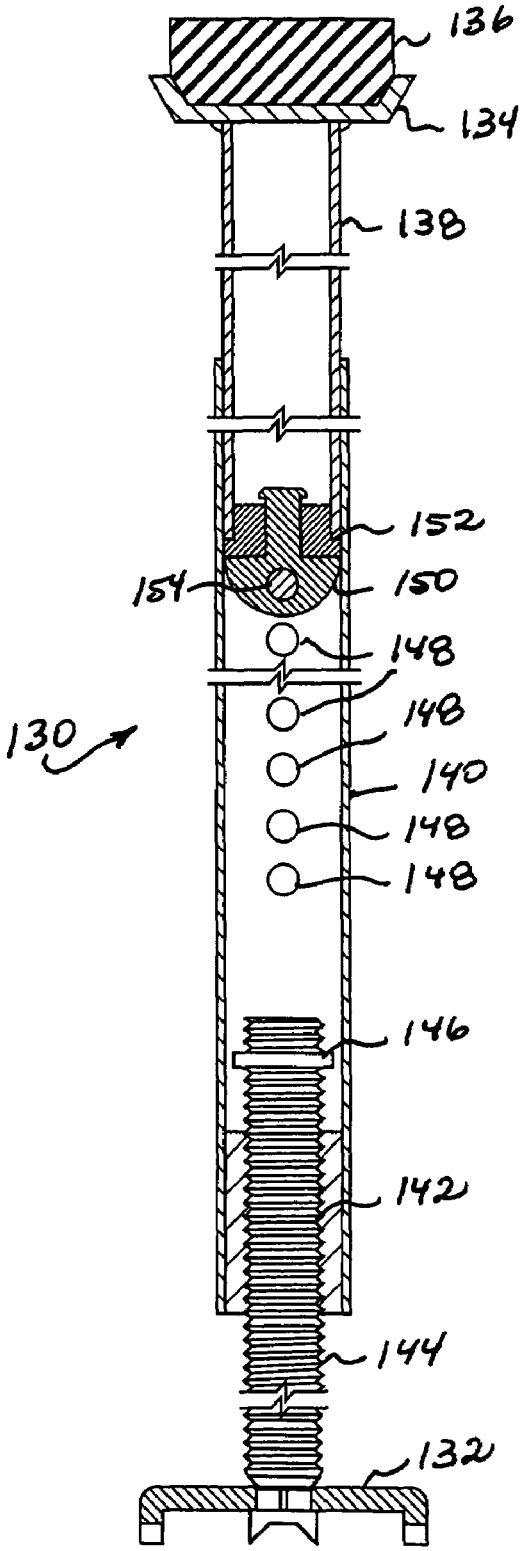
FIG. 14 is a cross-sectional view of an alternative embodiment of a support post made in accordance with the invention.

The support post 130 in FIG. 14 has a floor engaging end 132 which is similar to the floor engaging end 30 of support post 22 and therefore will not be described in any more detail. However, it has a ceiling engaging end 134 that has an outer surface covering 136 made of compressible material such as rubber or synthetic equivalents that are mechanically equivalent to providing the compressive load applied in the support post 22 to the top compression spring 58. The support post 130 has an inner tube 138 of circular cross-section which is telescopically received in an outer tube 140 which likewise has a circular cross-section. At the lower extremity of outer tube 140 a threaded collar 142 is attached to its internal surface for threaded engagement with a threaded post 144 having a bottom end which is rotatably coupled to the floor engaging end 132 and an upper free end which extends into the interior of the outer tube 140. A stop flange 146 is fixed to the upper threaded end of the post 144 to limit the relative position of the outer tube 140 to the threaded post 144.

The outer tube 140 has a series of longitudinally spaced apertures 148 formed in pairs on opposite sides of the outer tube. A lug 150 is rotatably coupled to an operatively lower end of the inner tube 138 through a bushing 152 fixed to the inner tube 138. The lug 150 has a pin receiving hole 154 which is adapted to align with a selected pair of the apertures 148 in the outer tube 140 in order to receive a locking pin (not shown) which traverses the outer tube 140 and the lug 150 to fix the relative position of the telescoping inner and outer tubes 138, 140.

In use, the telescoping inner and outer tubes 138, 140 are separated to approximate the height separating the ceiling from the associated supporting surface or floor and the locking pin is inserted as described above. Final adjustments of the height of the support post 130 is achieved by rotating the outer tube 140 on the threaded post 144 so as to extend the height of the support post. By virtue of the bushing 152, the ceiling engaging end 134 remains fixed against the upper engagement surface while the surface covering 136 is compressed. As in the case of the support post 22, the post is adapted to adjust dynamically to any dimensional changes as may occur due to settling, weather conditions, drying of the cement, etc. The dynamic adjustability at the ceiling engaging end eliminates the need to constantly check and adjust post height in order to ensure safety.

As will be appreciated by those skilled in the art, several other variations may be made to above-described embodiments of the invention within the scope of the appended claims.

I claim:

1. An extendable post installable between opposed surfaces, said post having:

a first longitudinally extending tube, a second longitudinally extending tube in sliding telescoping engagement with the first tube, a locking mechanism having an unlocked condition permitting relative sliding movement of the first tube relative to the second tube and a locked condition preventing relative sliding movement of the first tube relative to the second tube when the first tube and the second tube are in a desired longitudinal relationship, one of the first and second tubes having an open end which in use is adjacent one of said opposed surfaces, a surface engaging member having a stem slidably received in said open end and projecting beyond the open end, said stem having a portion of reduced diameter projecting from the open end of said one tube, said portion of reduced diameter having an outer surface that is spaced from an inner wall of said one tube, a spring within said one tube and acting on the stem to resiliently urge the stem in a direction out of the open end of the tube, and a retainer limiting movement of said stem in said direction, the retainer comprising a collar secured within said one tube at a position spaced from the open end thereof, a pin passing through an aperture in the collar, said pin having a head at one end which limits movement of the pin in said direction by engagement with the collar, said pin having an opposite end secured to the stem, and the spring being a vertical compression spring surrounding the pin between the collar and the stem.

2. An extendable post according to claim 1 wherein the projecting portion of the stem has a distinctive visual appearance compared to the visual appearance of the exterior of said one tube, whereby the amount of projection of the stem from the open end of the tube can be readily perceived.

3. An extendable post according to claim 1 wherein the surface engaging member is capable of rotatable movement relative to the stem.

* * * * *